US005161288A

United States Patent [19]

Chatman

[11] Patent Number: 5,161,288

[45] Date of Patent: Nov. 10, 1992

[54] MULTI-OCCUPANCY CASKET

[76] Inventor: Charles Chatman, 1566 Dianne Cir. East, Memphis, Tenn. 38114

[21] Appl. No.: 714,559

[22] Filed: Jun. 13, 1991

[51] Int. Cl.[5] ..... A61G 17/00

[52] U.S. Cl. ..... 27/2

[58] Field of Search ..... 27/1-8, 27/18, 19, 35

[56] References Cited

U.S. PATENT DOCUMENTS 3,997,949 12/1976 Waltz ..... 27/2

4,962,574 10/1990 Estes ..... 27/2

*Primary Examiner*—Richard E. Chilcot, Jr.

*Attorney, Agent, or Firm*—Leon Gilden

[57] ABSTRACT

A casket construction includes a central container cavity, including at least one support member directed medially of the container cavity, wherein the support member includes a respective first and second coplanar support, with a medially directed coplanar connecting rib accommodating support of a plurality of individuals upon the respective first and second support plates permitting positioning of the leg portions of the individuals below the support member within the container cavity. A plurality of lids are provided to provide selective access to each individual upon each respective support plate. The invention further includes a cover housing, wherein the cover housing is mounted upon a medial ledge positioned below an upper top surface of the side walls, wherein the housing includes furled cover webs extendable from within the housing to selectively cover discrete portions of individuals mounted upon the support member. The invention further includes a partition wall directed orthogonally between opposed end walls and medially between the side walls to permit positioning of a further support member in coplanar relationship relative to the support member to accommodate a further plurality of individuals thereon within a single casket construction.

6 Claims, 4 Drawing Sheets

MULTI-OCCUPANCY CASKET

BACKGROUND OF THE INVENTION

1. Field of the Invention

The field of invention relates to casket construction, and more particularly pertains to a new and improved multi-occupancy casket construction wherein the same is arranged for accommodating a plurality of individuals therewithin.

2. Description of the Prior Art

Escalating costs and restricted land use are limiting availability of cemetery space for casket burial. To accommodate such limited availability of land, the invention contemplates utilization of a unitary casket container accommodating a plurality of individuals therewithin.

Prior art casket construction, as typically utilized in the prior art, is exemplified in U.S. Pat. No. 1,887,665 to Truman wherein a refrigeration casket mounts a plurality of slide doors to a top surface thereof.

U.S. Pat. No. 3,997,949 to Waltz sets forth a casket for use in side-by-side burials wherein the side walls of the caskets are provided with normally closed windows and the handles are of a type enabling the two caskets to be positioned in proximity relative to one another to accommodate a substantially less than normal width spacing required of the adjacent caskets.

U.S. Pat. Nos. 3,188,711; 3,823,447; and 1,779,488 are patents illustrating various handle construction in the prior art that may be mounted in various relationships relative to caskets for various purposes of space saving construction.

As such, it may be appreciated that there continues to be a need for a new and improved multi-occupancy casket as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of casket constructions now present in the prior art, the present invention provides a multi-occupancy casket wherein the same utilizes a unitary casket housing a plurality of individuals therewithin for burial. As such, the general purpose of the present invention, which will be described subsequently in greater detail, is to provide a new and improved multi-occupancy casket which has all the advantages of the prior art casket construction and none of the disadvantages.

To attain this, the present invention provides a casket construction including a central container cavity, including at least one support member directed medially of the container cavity, wherein the support member includes a respective first and second coplanar support, with a medially directed coplanar connecting rib accommodating support of a plurality of individuals upon the respective first and second support plates permitting positioning of the leg portions of the individuals below the support member within the container cavity. A plurality of lids are provided to provide selective access to each individual upon each respective support plate. The invention further includes a cover housing, wherein the cover housing is mounted upon a medial ledge positioned below an upper top surface of the side walls, wherein the housing includes furled cover webs extendable from within the housing to selectively cover discrete portions of individuals mounted upon the support member. The invention further includes a partition wall directed orthogonally between opposed end walls and medially between the side walls to permit positioning of a further support member in coplanar relationship relative to the support member to accommodate a further plurality of individuals thereon within a single casket construction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-occupancy casket which has all the advantages of the prior art casket construction and none of the disadvantages.

It is another object of the present invention to provide a new and improved multi-occupancy casket which may be easily and efficiently manufactured and marketed.

It is a further object of the present invention to provide a new and improved multi-occupancy casket which is of a durable and reliable construction.

An even further object of the present invention is to provide a new and improved multi-occupancy casket which is susceptible of a low cost of manufacture with regard to both materials and labor, and which accordingly is then susceptible of low prices of sale to the consuming public, thereby making such multi-occupancy caskets economically avialable to the buying public.

Still yet another object of the present invention is to provide a new and improved multi-occupancy casket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
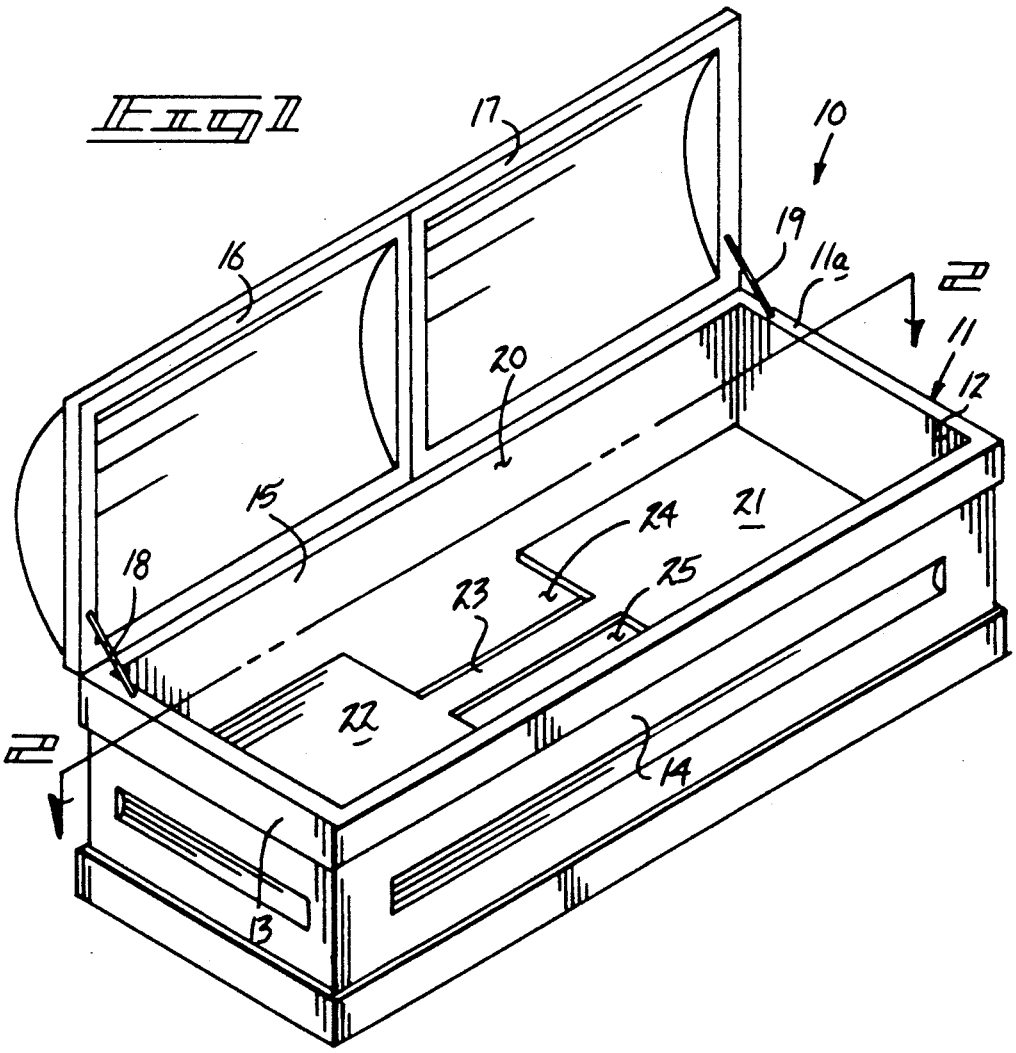
FIG. 1 is an isometric illustration of the invention.
Figure 2:
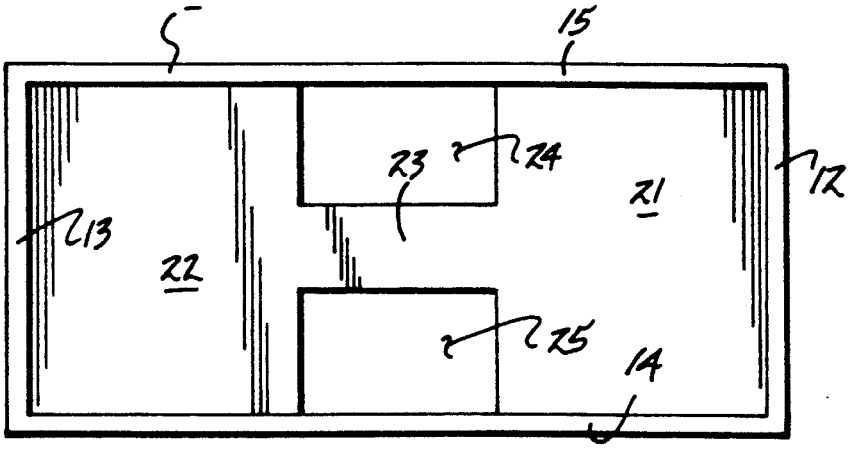
FIG. 2 is a top orthographic view of the instant invention.
Figure 3:
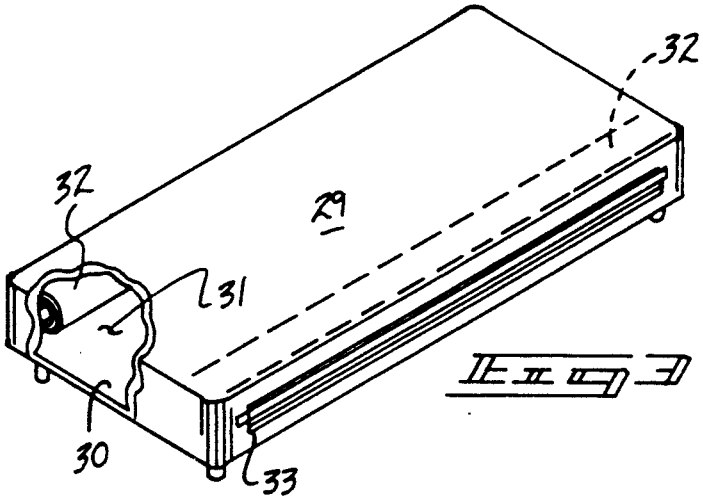
FIG. 3 is an isometric illustration of a cover housing utilized by the instant invention.

With reference now to the drawings, and in particular to FIGS. 1 to 6 thereof, a new and improved multi-occupancy casket embodying the principles and concepts of the present invention and generally designated by the reference numeral 10 will be described.

More specifically, the multi-occupancy casket 10 of the instant invention essentially comprises a central container 11, including a first end wall 12 spaced from and parallel a second end wall 13, each of an equal predetermined height, with a first and second respective side wall 14 and 15 arranged parallel relative to one another and between the first and second end walls 12 and 13. A top surface of each of the walls 12–15 defines a coplanar perimeter top surface 11*a*, with the top surface 11*a* defining an upper terminal end of the second side wall 15 hingedly mounting a respective first and second lid 17 and 16 respectively. A respective first and second mounting length 19 and 18 mount the first and second lids relative to the second side wall 15. The perimeter top surfaces 11*a* defines a container opening 20 defined by a predetermined area, with the first and second lids 17 and 16 arranged to overlie the area when in a lowered position.

A support member 40 is mounted orthogonally within the central container 11 orthogonally oriented relative to the walls 12–15, including a first support plate 21 coplanar with a second support plate 22 and spaced therefrom, with a connecting rib 23 coplanar with first and second support plates 21 and 22 arranged to secure the first and second support plates together to define a generally "I" shaped configuration. First support plate 21 is mounted to the first end wall 12, as well as the first and second side walls 14 and 15. The second support plate 22 is mounted to the second end wall 13, as well as the first and second side walls 14 and 15. The support member therefore permits positioning of a respective first and second individual upon a respective first and second support plate 21 and 22, with the individuals' legs projecting within the first and second slots 24 and 25 defined by the openings between the side walls and the connecting rib 23.

A medial ledge 26 is arranged parallel to and below the perimeter top surface 11*a* and includes plural pairs of mounting bores 27 directed therethrough adjacent the respective first and second side walls 14 and 15, with each of the mounting bores receiving a positioning peg 28 mounted to a cover housing floor of an associated cover housing 29. The cover housing further includes a central cover housing cavity 31 mounting a plurality of furled cover webs 32 therewithin. The housing 29 further includes side wall slots 33 directed through each side wall of the cover housing 29 in confrontation to the end walls 12 and 13 thereby arranging a slot 33 parallel to each respective end wall. In this manner, a web 32 may be extended as desired from the cover housing 29 through a respective slot 33 to overlie a desired portion of an individual cadaver mounted upon a respective support plate of the first and second support plates 21 and 22. Further, a hook and loop fastener surface 34 (see FIG. 5) may be provided upon the medial ledge 26 for cooperation with a further hook and loop fastener surface mounted to the respective web 32 to maintain a web in a predetermined extended orientation relative to the housing 29.

Figure 4:
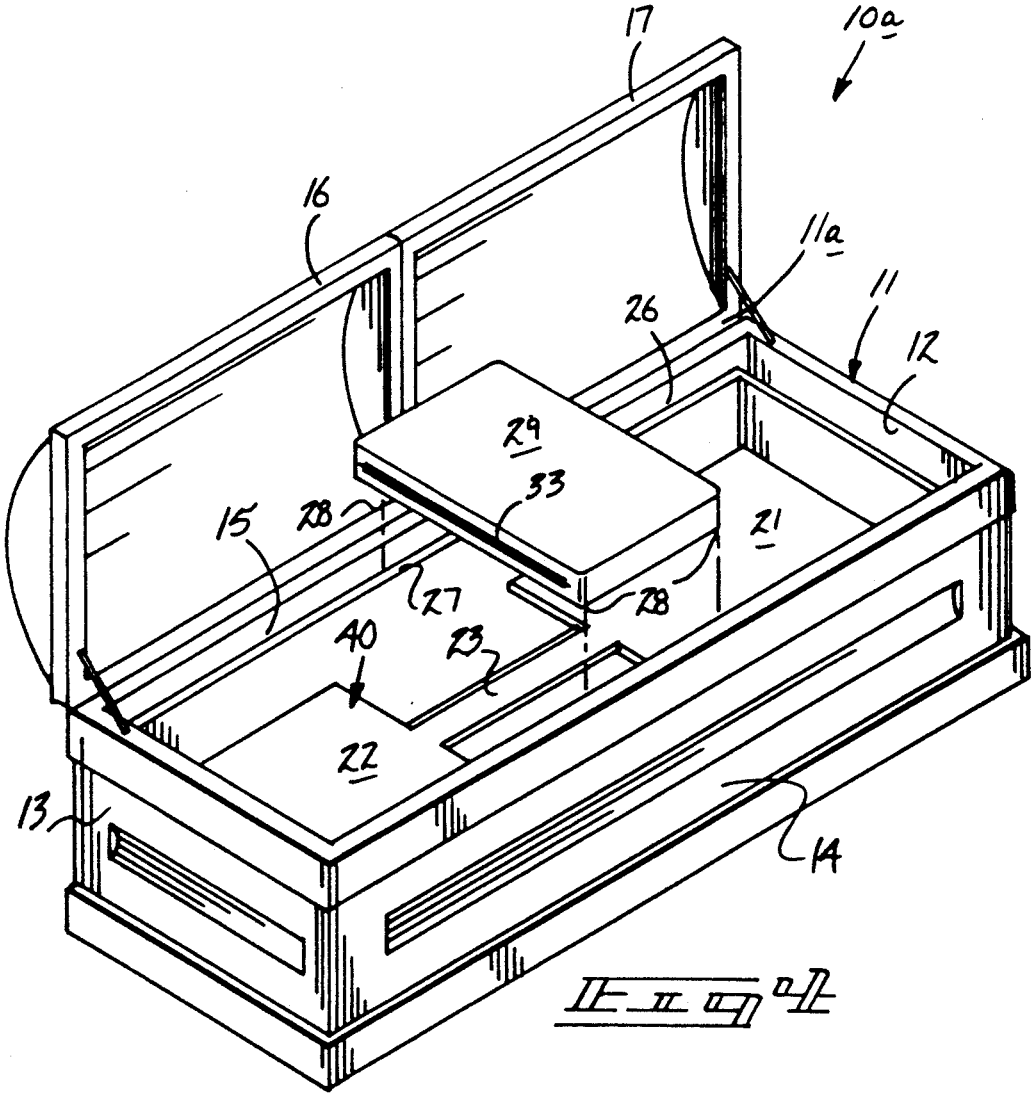
FIG. 4 is an isometric illustration of the casket construction utilizing a cover housing, as illustrated in FIG. 3.
Figure 5:
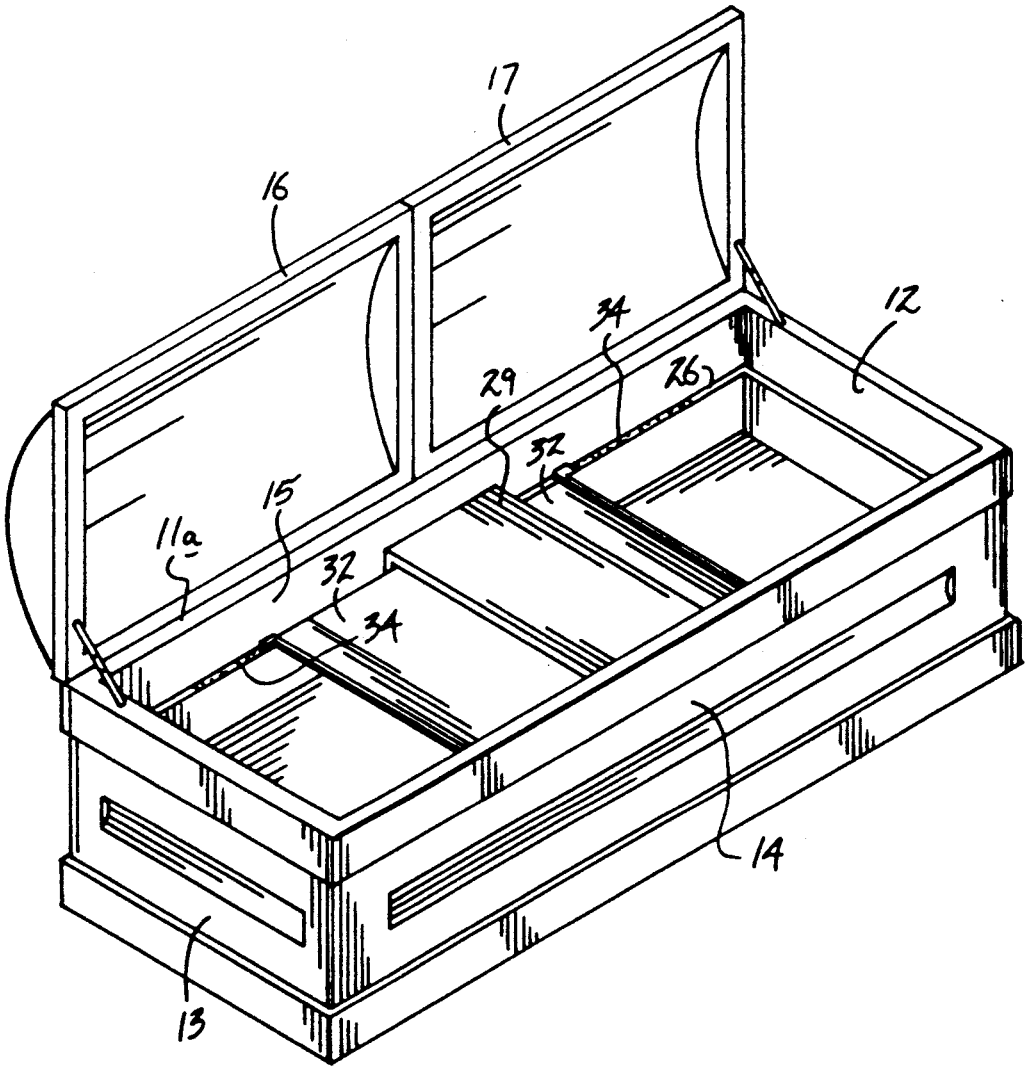
FIG. 5 is an isometric illustration of the casket construction invention in an assembled configuration.
Figure 6:
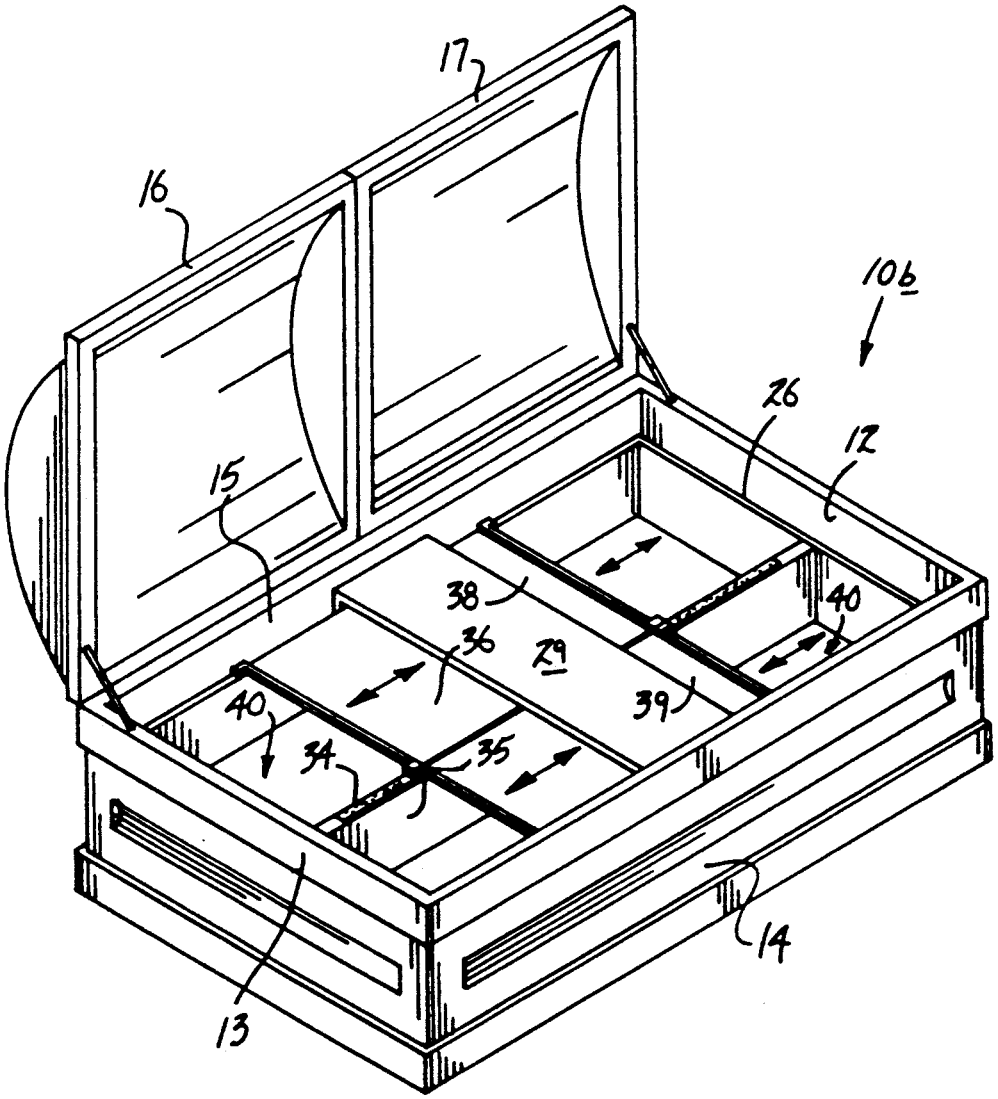
FIG. 6 is an isometric illustration of a modification of the casket construction for accommodating plural pairs of individuals therewithin.

FIG. 6 illustrates a modified aspect of the invention 10*b* in contrast to the first modified aspect 10*a*, as illustrated in FIG. 4, wherein a single unitary cover housing 29 extends, as indicated in the embodiment of FIG. 5, spanning the spaced side walls 14 and 15, but including a respective first and second cover web 36 and 37 extending through a forward slot, and a third and fourth respective cover web 38 and 39 extending through a rear slot. A partition wall 35 is orthogonally directed medially between the first and second end walls 12 and 13 parallel to the first and second side walls 14 and 15 medially positioned between the first and second side walls. A respective support member 40 is mounted between the partition wall 35 and each respective first and second side wall 14 and 15. A respective support member 40 is accordingly associated with a first and third cover web 36 and 38, and a further support member associated with a respective second and fourth cover web 37 and 39, as illustrated in FIG. 6. In this manner, plural pairs of cadavers may be mounted within the casket construction 10*b*, as illustrated in FIG. 6. The hook and loop fastener surface 34 is accordingly positioned upon a top surface of the partition wall 35 cooperative with each of the cover webs 36–39 to maintain the webs in a desired extended orientation relative to the housing 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-occupancy casket, comprising, a central container, the container including a first end wall spaced from and parallel a second end wall, and a first side wall spaced from and parallel a second end wall, and a first side wall spaced from and parallel a second side wall, and the walls defining a coplanar perimeter top surface, and the second side wall hingedly mounting a first and second lid, the first and second lids arranged for selective covering of a container opening defined by the perimeter top surface, and a support member orthogonally mounted interiorly of the container orthogonally oriented relative to each end wall, wherein the support member is arranged for mounting a plurality of cadavers thereon.

2. A casket as set forth in claim 1 wherein the support member includes a first support plate coplanar with a second support plate, the second support plate and the first support plate including a connecting rib, the connecting rib coplanar with the first support plate and the second support plate, and the connecting rib defining a first slot and a second slot between the respective first side wall and second side wall, the support member arranged in a parallel spaced relationship relative to a floor of the container.

3. A casket as set forth in claim 2 including a medial ledge mounted coextensively through the central container contiguous with an interior surface of each wall, the medial ledge arranged parallel to and spaced below the perimeter top surface, the medial ledge removably mounting a cover housing, the cover housing positioned medially of the container opening when mounted on the medial ledge.

4. A casket as set forth in claim 3 wherein the covering housing includes a cover housing floor spaced from a cover housing top wall defining a cover housing cavity therewithin, and a first and second cover housing slot directed through the cover housing in communication with the cover housing cavity, and the first and second slot in parallel spaced relationship relative to first and second end walls, and the covering housing cavity including a respective first and second web mounted within the cover housing cavity, each web arranged for extension relative to the cover housing.

5. A casket as set forth in claim 4 wherein the medial ledge includes a hook and loop fastener surface thereon, and the first and second web includes a further hook and loop fastener surface cooperative with the hook and loop fastener surface to permit securement of each web in extended orientation relative to the cover housing.

6. A casket as set forth in claim 5 wherein the container includes a partition wall orthogonally oriented between the first end wall and the second end wall, and in a spaced parallel relationship relative to the first side wall and the second side wall, and the container including the support member mounted between the partition wall and the second side wall, and a further support member mounted between the partition wall and the first side wall, the support member and the further support member coplanar relative to one another, and the further support member including a further first slot and a further second slot, and the cover housing extending above the first slot, second slot, further first slot, and further second slot, and a respective third and fourth web positioned above the further support member within the cover housing, and the partition wall including partition wall hook and loop fastener surface cooperative with each web for maintaining each web in an extended orientation relative to the cover housing.

* * * * *